US009139356B2

(12) United States Patent
Kim

(10) Patent No.: US 9,139,356 B2
(45) **Date of Patent: *Sep. 22, 2015**

(54) COMBINATION TRANSPARENT SHIRT BOX, SHIRT AND TIE

(71) Applicant: Peacock Apparel Group, Inc., New York, NY (US)

(72) Inventor: Cin Kim, Alpine, NJ (US)

(73) Assignee: PEACOCK APPAREL GROUP, INC., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/055,395

(22) Filed: Oct. 16, 2013

(65) Prior Publication Data

US 2014/0102920 A1 Apr. 17, 2014

Related U.S. Application Data

(63) Continuation of application No. 12/535,450, filed on Aug. 4, 2009, now Pat. No. 8,579,109, which is a continuation of application No. 11/435,830, filed on May 16, 2006, now Pat. No. 7,621,393, which is a continuation-in-part of application No. 11/222,040, filed on Sep. 7, 2005, now abandoned.

(51) Int. Cl.
*B65D 85/18* (2006.01)

(52) U.S. Cl.
CPC ..... *B65D 85/18* (2013.01); *B65D 85/182* (2013.01)

(58) Field of Classification Search
CPC ..... B65D 85/18; B65D 85/182
USPC ..... 229/87.17; 206/278, 279, 292; 2/145, 2/146, 481; 24/66.11
See application file for complete search history.

(56) References Cited

U.S. PATENT DOCUMENTS

| | | | |
|---|---|---|---|
| 698,266 | A | 4/1902 | Elliott |
| 982,948 | A | 1/1911 | Griesemer |
| 1,253,457 | A | 1/1918 | Atkinson |
| 1,760,473 | A | 5/1930 | Bruehl |
| 1,862,353 | A | 6/1932 | Allison |
| 1,995,864 | A | 3/1935 | Reinhold |
| 2,063,255 | A | 12/1936 | Madsen et al. |

(Continued)

FOREIGN PATENT DOCUMENTS

DE 29702371 U1 * 3/1997

OTHER PUBLICATIONS

U.S. Appl. No. 12/171,574, filed Jul. 11, 2008, Kim.

(Continued)

*Primary Examiner* — Sue A Weaver
(74) *Attorney, Agent, or Firm* — Leason Ellis LLP

(57) ABSTRACT

A substantially transparent box is constructed and arranged to include a collared shirt and a necktie in arrangement relative to one another and disposed such that these clothing articles are in registry with a hole in the box. The box comprises a single sheet of substantially transparent plastic having a series of first and second panels each being defined by respective folds. Selected first panels are bonded to another to define a hollow central cavity for the box, whereas selected second panels are folded to define peripheral ends for the box. The hollow cavity is sized to receive the shirt and necktie. The shirt and necktie are optionally arranged with bands that maintain a prescribed relative position to each other and to the box.

13 Claims, 10 Drawing Sheets

(56) References Cited

U.S. PATENT DOCUMENTS

| | | | | |
|---|---|---|---|---|
| 2,093,830 | A | | 9/1937 | Flatley |
| 2,195,373 | A | | 3/1940 | Synder et al. |
| 2,233,207 | A | | 2/1941 | Gillam |
| 2,403,047 | A | | 9/1944 | Buttery |
| 2,907,045 | A | | 10/1959 | O'Reilly |
| 3,043,494 | A | | 7/1962 | Moore |
| 3,060,448 | A | | 10/1962 | Mongelli |
| 3,066,792 | A | | 12/1962 | Spilman |
| 3,308,935 | A | | 3/1967 | Cote |
| 3,346,881 | A | | 10/1967 | Mathison |
| 3,363,264 | A | | 1/1968 | Mathison |
| 3,506,978 | A | | 4/1970 | Santona |
| 3,511,364 | A | | 5/1970 | Airdo |
| 3,670,881 | A | | 6/1972 | Dutcher |
| 3,831,201 | A | | 8/1974 | Burny, Jr. |
| 3,890,678 | A | | 6/1975 | Leonard |
| 3,964,105 | A | | 6/1976 | Gideon |
| 3,999,222 | A | | 12/1976 | Walborn |
| 4,046,253 | A | | 9/1977 | Weaver |
| 4,173,792 | A | | 11/1979 | Intengan |
| 4,182,224 | A | | 1/1980 | Dutcher |
| D261,479 | S | | 10/1981 | Marks |
| 4,546,494 | A | | 10/1985 | Garber |
| 4,590,610 | A | | 5/1986 | Rhyne |
| 4,667,346 | A | | 5/1987 | Strollo |
| 4,762,272 | A | | 8/1988 | Herrin |
| 4,856,709 | A | | 8/1989 | Axelsson et al. |
| 4,933,991 | A | | 6/1990 | Love |
| 5,002,220 | A | | 3/1991 | Safranski |
| D343,356 | S | | 1/1994 | Wittman |
| D346,960 | S | | 5/1994 | Bennett |
| 5,316,139 | A | | 5/1994 | Judd et al. |
| D349,181 | S | | 8/1994 | Cheng |
| 5,499,484 | A | | 3/1996 | Herrin |
| D368,588 | S | | 4/1996 | Goraleski et al. |
| 5,549,243 | A | | 8/1996 | Dorier et al. |
| 5,673,434 | A | | 10/1997 | Risk |
| D390,339 | S | | 2/1998 | Dipietro |
| 5,774,893 | A | | 7/1998 | Torres |
| 6,012,573 | A | * | 1/2000 | Kurimoto ..... 206/278 |
| 6,041,998 | A | | 3/2000 | Goldberg et al. |
| 6,102,279 | A | | 8/2000 | Dowd |
| 6,126,000 | A | | 10/2000 | Tung |
| 6,142,365 | A | | 11/2000 | Breitbach |
| 6,460,189 | B1 | | 10/2002 | Welch |
| 6,499,590 | B1 | | 12/2002 | Godshaw et al. |
| D492,595 | S | | 7/2004 | Chang |
| 6,901,636 | B2 | | 6/2005 | Kim |
| 6,978,518 | B2 | | 12/2005 | Kim |
| 7,096,509 | B2 | | 8/2006 | Kim |
| 7,114,220 | B2 | | 10/2006 | Kim |
| D546,674 | S | | 7/2007 | Limber |
| D553,495 | S | | 10/2007 | Vandecasteele et al. |
| 7,310,857 | B2 | | 12/2007 | Kim |
| D565,965 | S | | 4/2008 | Kim |
| D565,966 | S | | 4/2008 | Kim |
| D574,722 | S | | 8/2008 | Kim |
| D574,723 | S | | 8/2008 | Kim |
| D574,724 | S | | 8/2008 | Kim |
| D574,725 | S | | 8/2008 | Kim |
| D574,726 | S | | 8/2008 | Kim |
| D574,727 | S | | 8/2008 | Kim |
| D574,728 | S | | 8/2008 | Kim |
| D574,729 | S | | 8/2008 | Kim |
| D574,730 | S | | 8/2008 | Kim |
| D589,364 | S | | 3/2009 | Kim |
| D589,365 | S | | 3/2009 | Kim |
| D589,366 | S | | 3/2009 | Kim |
| D589,367 | S | | 3/2009 | Kim |
| D590,724 | S | | 4/2009 | Kim |
| D590,725 | S | | 4/2009 | Kim |
| D590,726 | S | | 4/2009 | Kim |
| 7,621,393 | B2 | | 11/2009 | Kim |
| 2006/0010560 | A1 | | 1/2006 | Kim |
| 2007/0062846 | A1 | | 3/2007 | Kim |

OTHER PUBLICATIONS

U.S. Appl. No. 29/318,152, filed May 14, 2008, Kim.
U.S. Appl. No. 29/318,279, filed May 16, 2008, Kim.
U.S. Appl. No. 29/318,283, filed May. 16, 2008, Kim.
U.S. Appl. No. 29/320,041, filed Jun. 19, 2008, Kim.
U.S. Appl. No. 29/326,598, filed Oct. 21, 2008, Kim.
U.S. Appl. No. 29/325,199, filed Sep. 26, 2006, Kim.
U.S. Appl. No. 29/325,195, filed Sep. 26, 2008, Kim.

* cited by examiner

COMBINATION TRANSPARENT SHIRT BOX, SHIRT AND TIE

This application is a continuation patent application of U.S. patent application Ser. No. 12/535,450, filed Aug. 4, 2009, now U.S. Pat. No. 8,579,109, issued Nov. 12, 2013, which is a continuation U.S. patent application Ser. No. 11/435,830, filed May 16, 2006 now U.S. Pat. No. 9,621,393, issued Nov. 24, 2009, which claims the benefit of priority under 35 U.S.C. §120 from application Ser. No. 11/222,040, filed Sep. 7, 2005, entitled "Transparent Shirt Box," (published as U.S. patent application publication No. 2007-0051788), each of which are hereby incorporated by reference in their entirety herein.

BACKGROUND OF THE INVENTION

In the retail sale of coordinated dress shirts and tie combinations, it is desirable to present the merchandise in a manner that permits potential customers to have a good look at the product. On the other hand, it is important for retailers to keep the product clean and free of any soil or stains that may result from handling, to protect against theft, and to maintain the shirts in an orderly and well-folded condition so that their displays remains attractive to passers by.

It is also desirable that the packaging that is used be economical to manufacturer, that it be made from a recyclable material, and that it be made with minimal waste.

It is also desirable to have a packaging that addresses the foregoing needs and which permits coordinated shirt and tie combinations to be stacked in great number to promote efficient shelf and display space usage.

The present invention satisfies these and other needs.

SUMMARY OF THE INVENTION

In accordance with one aspect of the present invention, a combination of clothing articles and a substantially transparent box is constructed and arranged to include a collared shirt, a necktie supported by the shirt, and a single sheet of substantially transparent plastic having a series of first panels each defined by a respective fold in a series of first folds and a set of second panels each defined by a respective fold in a set of second folds in the plastic sheet. A bond permanently connects one of the first panels to another of the first panels so as to define a hollow central cavity for the box. The hollow cavity is sized to receive the shirt and necktie. The second panels are folded to define first and second peripheral ends of the box. The plastic sheet comprising the box includes a hole positioned relative to the clothing articles such that the outline of the hole overlies a portion of the articles.

In a further aspect, the invention includes the combination as described above having the necktie folded intermediate its ends and seated relative to the folded shirt by an elastic band which passes transversely to a length of necktie, within the fold. The band can comprise a loop and can be sized to be stretchably received about the shirt collar. Optionally, a clip can engage with the fabric of the necktie proximate to the fold to pinch the fabric and thereby emulate the appearance of a tie knot.

In a still further aspect, the invention as described above can include a band or loop disposed about the folded shirt, and a channel adjacent the loop. The necktie can be disposed within the channel.

In yet another aspect, the invention as described above has the bond connecting the first panels defined by a plurality of individual bond sites which are intermittently spaced apart. Optionally, the individual bond sites can be arranged in at least one line.

In still another aspect, the invention as defined above can further have double-sided tape members with opposing sides in adhesive contact with respective second panels to permit ready closing of the box once filled with a shirt and tie.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
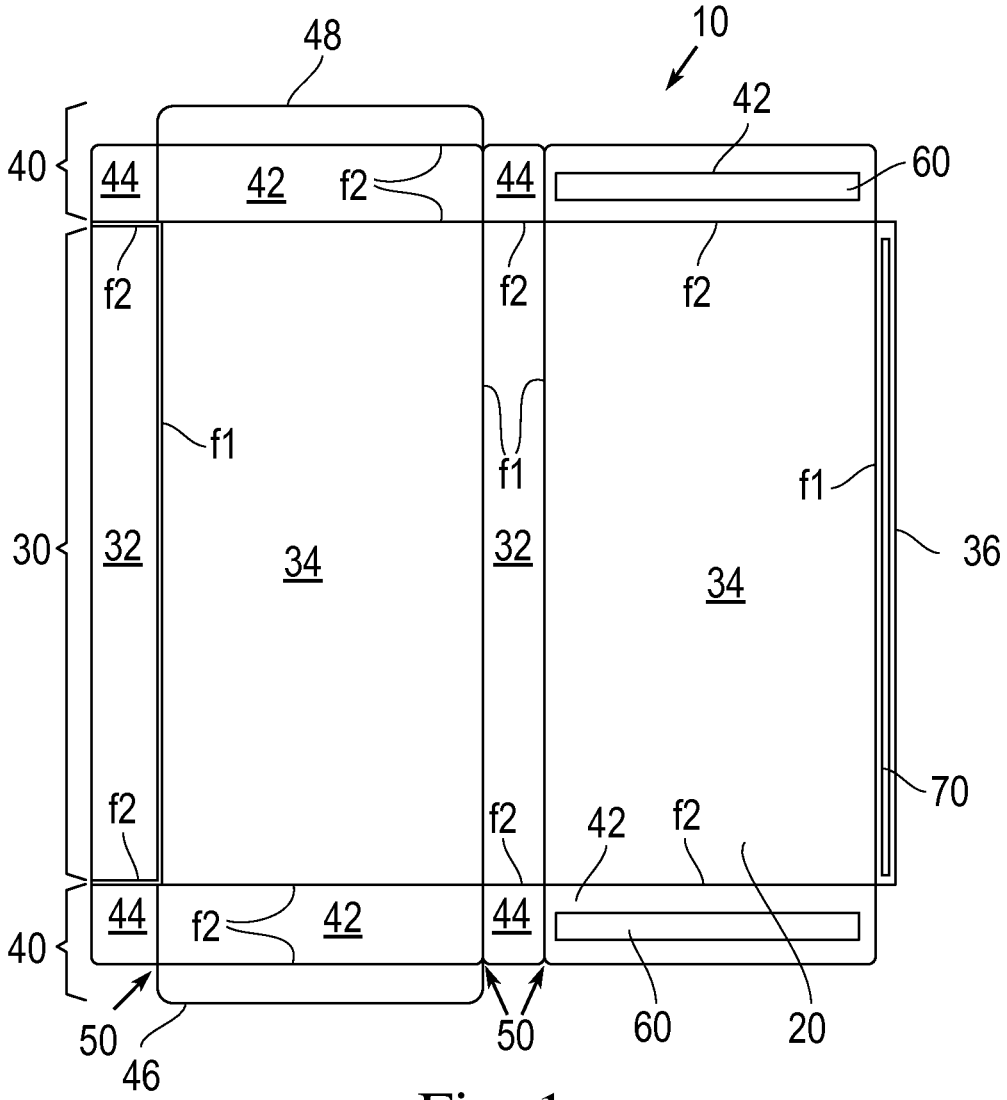
FIG. 1 is a top plan view of a first embodiment in accordance with the invention.

Referring to FIG. 1, a shirt box container 10 comprises a substrate 20 in the form of a transparent plastic sheet having fold lines generally designated F1 and F2. The fold lines F1 are generally parallel and preferably are parallel to one another. The fold lines F2 are also generally parallel and preferably are parallel to one another. The fold lines F1, F2 define boundaries of respective panels of the substrate 20. A series of first panels 30 all fold in a first direction and include panels 32, 34, and 36. Each of the panels in the series 30 is disposed adjacent another panel in the series and is separated from a next panel by one of the fold lines F1.

Figure 2:
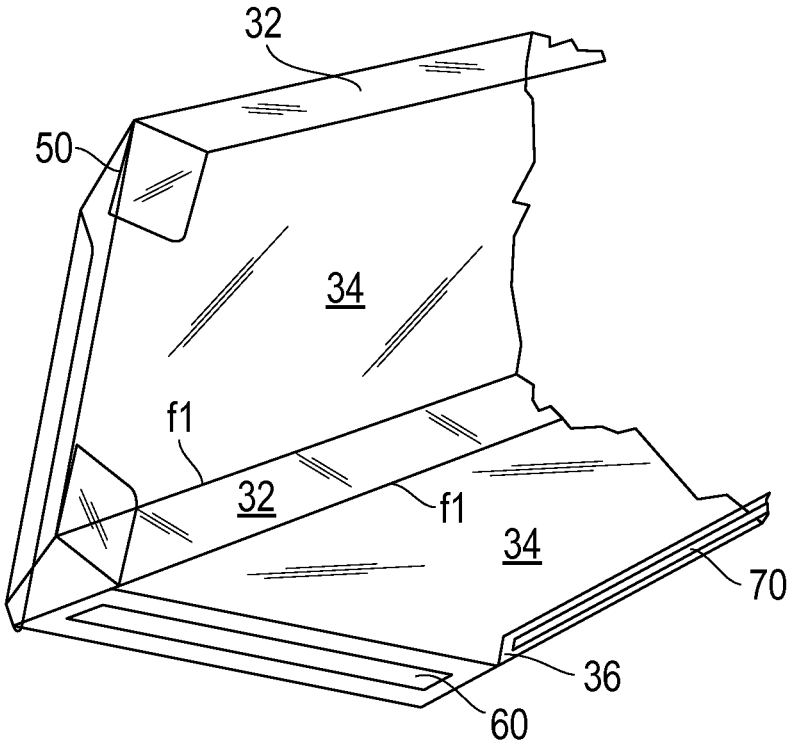
FIG. 2 is a perspective view of the embodiment of FIG. 1 showing the shirt box in a partially folded position.

As shown in FIG. 2, the first series of panels 30 is foldable along the fold lines F1 along a common, parallel direction to define a hollow central cavity for the shirt box.

Referring now to FIGS. 1 and 2, a set of second panels 40 have a boundary along the fold lines F2 to respective panels in the first series 30. Thus, panels 42 are bounded along one margin at the fold lines F2 to panel 34 and flaps 44 are bounded along fold lines F2 to panels 32. In the embodiment of FIG. 1, the second set of panels 40 further includes end flaps 46 which fold about fold line F2 and which are joined to a free end of panels 42. Each of the panels 42 and end flaps 44 has a free end, opposite its bounded end and each is adjacent to a notch 50, which separate a portion of the panels 42 and end flaps 44 from the remainder of the substrate 20. As can be appreciated from FIG. 2, the panels in the second set 40 are foldable along their respective fold lines F2 in a direction which is substantially perpendicular to the direction of fold lines F1. In folding the second set of panels 40, peripheral ends of the shirt box 10 are defined.

The notches 50 are generally oriented to extend in the same direction as the fold lines F1, and preferably are axially aligned with the fold lines F1.

In accordance with a salient aspect of the present invention, the shirt box 10 can be configured in a partially assembled state in which a hollow central cavity for containing a shirt or a shirt and tie combination is defined, yet which is collapsible into a generally flat state until such time that a shirt (or a shirt and tie combination) is to be inserted into the box. When the shirt box 10 is to be filled, it is brought to an uncollapsed state, the shirt is introduced into the hollow cavity, and the peripheral ends of the shirt box are bonded so as to define a substantially rectangular and sealed shirt box construction.

Figure 3:
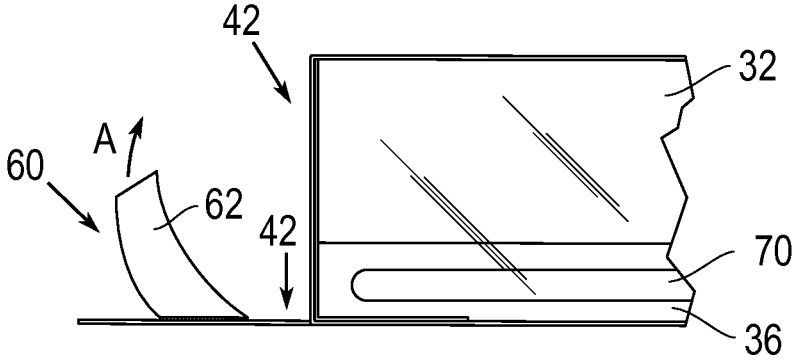
FIG. 3 is a detailed end view of the embodiment of FIG. 1 showing a securement for securing the box in a closed state.

With further reference to FIGS. 1 and 2, a securement 70 extends along an inner margin of the panel 36 for permanently connecting panel 36 to another panel in the series, preferably one of the panels 32. As shown in FIG. 3, the securement 70 comprises a bond (e.g., thermal or adhesive) which is made between panels 36 and 32 so as permanently connect those panels and secure the shirt box 10 in a rectangular configuration. The bonds preferably comprises a contact cement; however, the bond can comprise other generally permanent connections as understood by those skilled in the art. Preferably, the bond is "permanent" in that it is of such character that it is not readily opened by a consumer, and yet is sufficiently strong to permit the box to be collapsed laterally, so that the panels of the first series 30 can be folded along fold lines F1 to define the shirt cavity while the peripheral ends remain unattached to thereby permit the shirt box to assume a flat condition.

Optionally, the bond comprises a series of individual bond sites intermittently spaced apart and arranged (e.g. linearly, evenly spaced, or both) along the length of panel 32 to define the securement. Each such bond site can be formed by applying heat and pressure such that the panels are adhered to one another. The resulting bond site can be indented on one side and bulged on the opposite side. Each individual bond site can therefore have the appearance of the two panels having been crimped together.

Figure 4:
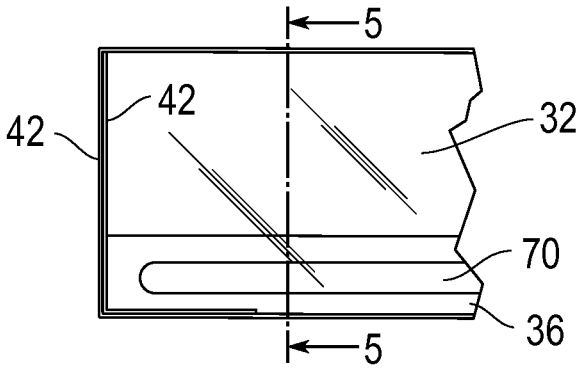
FIG. 4 shows the box of FIG. 3 in the closed state.

The shirt box 10 further includes a first and second double sided tape member 60 having a first side in adhesive contact with a respective panel in the second set of panels 40. As illustrated in FIGS. 1-3, the double-sided tape member is disposed on end panel 42. A second side of the double-sided tape member 60 includes a removable strip 62 (best seen in FIG. 3) which overlies the second side of the tape member 60. The removable strip maintains the second side of the tape member 60 free of tackiness so that shirt boxes 10 can be stacked in a collapsed state without sticking to one another. However, the removable strip 62 can be separated from the second side of the tape member 60 by releasing it in the direction of arrow A so as to expose an adhesive surface which permits engagement of one panel 42 with another panel 42 (see FIG. 4). Once the panels 42 have been adhesively joined by the tape member 60, the shirt box 10 is in the second state in which the hollow central cavity is sized to receive the shirt or shirt and tie combination.

Preferably, the material of the substrate has a thickness so that, in combination with the fold lines F1 and F2, a stable, second state results in which the shirt boxes 10 can be stacked in great number, one upon another, to promote efficient shelf and display space usage.

In order to facilitate folding of the shirt box, in a preferred form, the end panels 46 have chamfered corners adjacent their respective free ends. The chamfered corners reduce interference of one panel member with another as the box is folded.

As illustrated in FIGS. 1-4, it is preferred that the panels in the second set 40 extend symmetrically from the margins of the panels in the first series 30.

Figure 5:
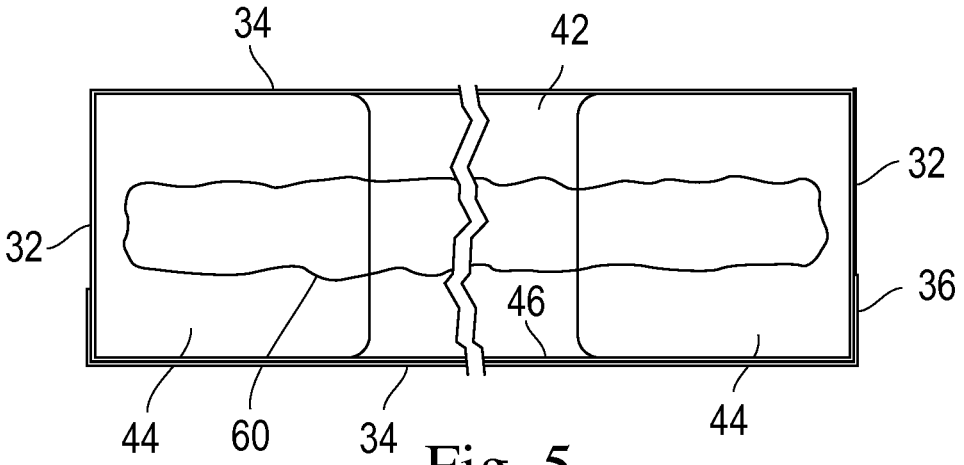
FIG. 5 is a cross-section through lines 5-5 of FIG. 4.

FIG. 5 is a cross-sectional view through the folded box in accordance with first the embodiment described above. FIG. 5 shows the relative relationship of the different panels with the shirt box 10 in the fully folded configuration.

Figure 6:
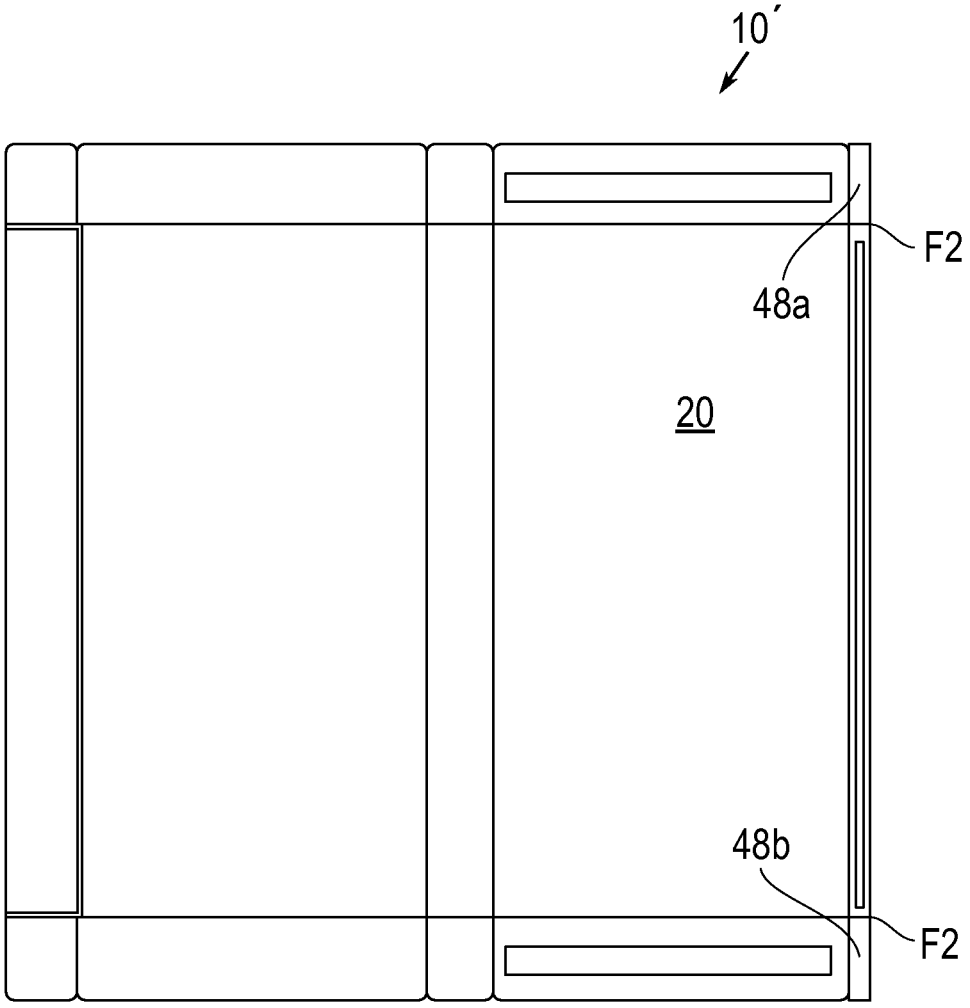
FIG. 6 is a top plan view of a second embodiment in accordance with the invention.
Figure 7:
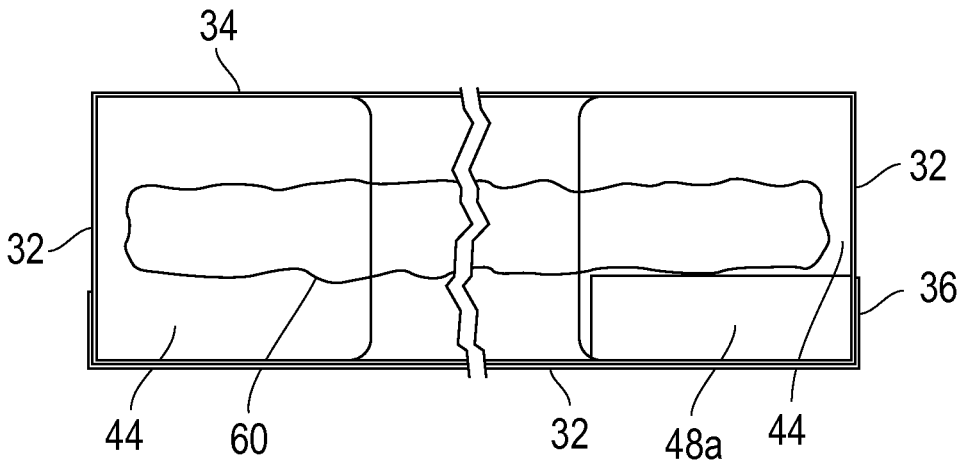
FIG. 7 is a cross-section of the second embodiment taken along the same lines as that of FIG. 5.

Referring now to FIG. 6, a second embodiment of shirt box 10' is illustrated in which like reference numbers are used to refer to corresponding features. In relevant part, the second embodiment differs from the first embodiment in that it has been specially configured in order to minimize waste material as the substrate 20 is stamped from a web of material by providing an overall rectangular configuration free of cutouts. As in the first embodiment, it is preferred that a single sheet of substantially transparent plastic is used to define the panels of the shirt box 10'; however, in order to minimize waste material, the end flaps 46 have been eliminated, and new flaps 48*a* and 48*b* are included in the second set of panels 40. The flaps 48A, 48B are folded about fold line F2 when the substrate 20 is folded to define the shirt box 10'. Thus, as shown in FIG. 7, the folded shirt box lacks the end panel 46, so the top and bottom margins of the folded box have the same thickness throughout the length of the shirt box. The additional flap 48*a* is accommodated within the folded box, as illustrated in FIG. 7.

The fold lines F1 and F2 can be continuous or discontinuous, but preferably are continuous and more preferably comprise score lines in the substrate 10. Depending on the material chosen for the substrate, fold lines can be defined by material at locations that are axially aligned with the notches 50. Also, at least one of the notches 50 preferably has a depth (that is, in a direction parallel to the axis of the fold lines F1) which is equal to the width of the flaps 44. By so-constructing at least some of the notches 50, a substantially rectangular shirt box 10, 10' can result.

Figure 8:
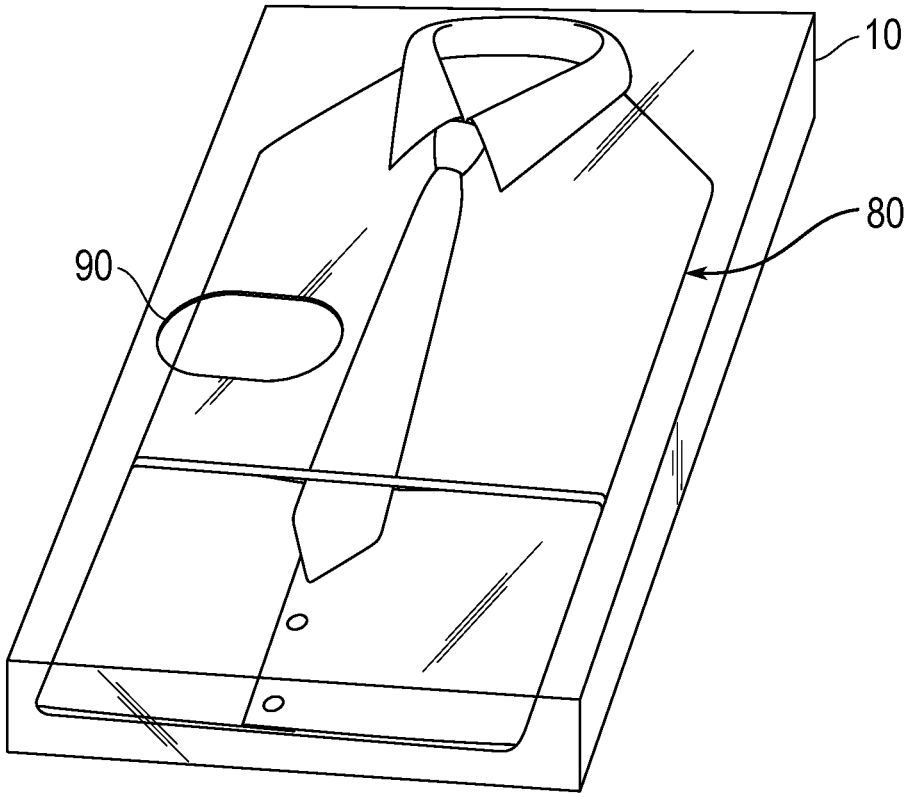
FIG. 8 shows the shirt and tie combination disposed within the box.

Referring to FIG. 8, a shirt and tie combination 80 is disposed within the hollow central cavity of shirt box 10. Preferably, shirt box 10 is formed with a hole 90 in one of the panels that forms the box. Hole 90 is positioned such that the outline of the hole overlies a portion of the shirt and tie combination 80. This arrangement provides access to the garments inside the shirt box 10 so that consumers can touch and feel the garments yet does not compromise the structural integrity of the box 10.

Figure 9:
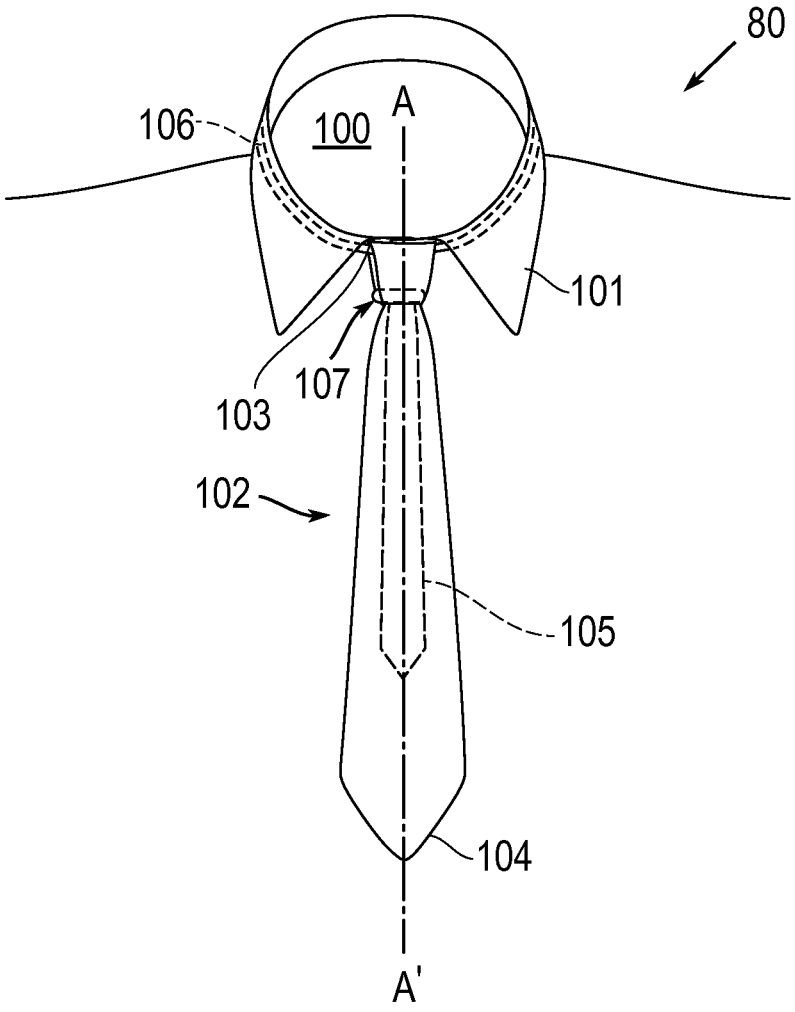
FIG. 9 is a front view of the shirt and tie combination.

FIG. 9 is a front view of the shirt and tie combination 80. The shirt 100 is preferably folded as shown. The shirt 100 includes a collar 101. A necktie 102 is located proximate to the collar. The necktie essentially comprises a length of fabric. It may be any suitable fabric such as silk. The necktie may also comprise a combination of fabrics. The fabric of the necktie generally extends in the vertical direction (along line A-A') as shown in FIG. 9. The necktie has a first end 104 and a second end 105.

The necktie 102 is folded between the first and second ends to create a fold 103. The fold is horizontal in FIG. 9, thus being in a direction transverse to that of the fabric of the necktie (namely, transverse to line A-A'). An elastic band 106 is placed within the fold, or within at least one of the several folds if several are present. The elastic band 106 is preferably manufactured from rubber, but may be manufactured from an elastic fabric, or a flexible elastic plastic material. The elastic band 106 passes through the fold in a generally horizontal direction, i.e. direction transverse to that in which the necktie extends. The elastic end is resiliently stretched upward and preferably around the collar 101. Preferably, the elastic band comprises a loop which is slightly shorter than the circumference of the collar, thus necessitating it to be stretched when wrapped around the collar.

Figure 10:
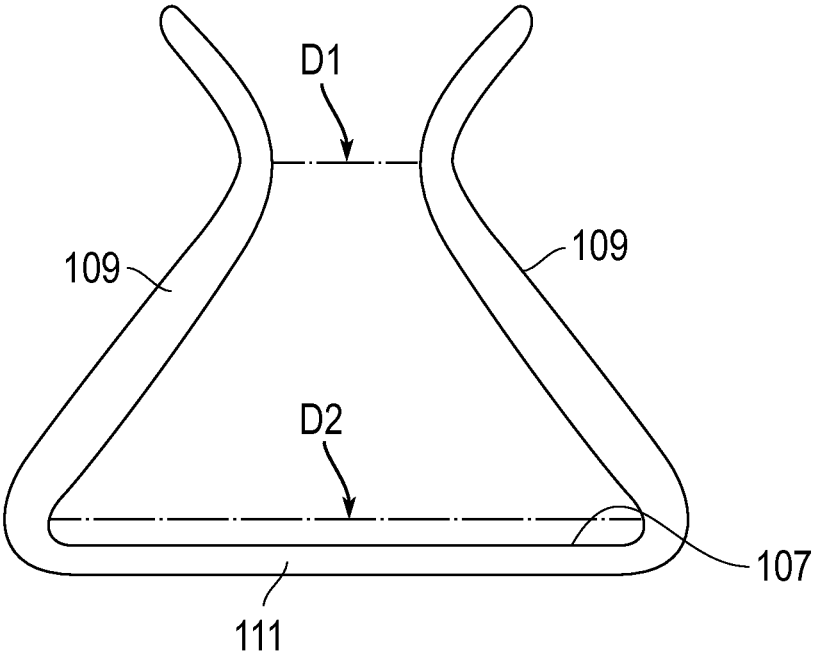
FIG. 10 shows a clip useful in configuring the tie to appear knotted.

A clip 107 is placed on the necktie in a position proximate to the fold. The clip 107 is preferably placed about 1-1.5 inches below the fold. The clip pinches the necktie in order to create the appearance of a knot, as shown in FIG. 9. The illustrated clip 107 has a pair of legs 109 that attached to and extend upward from a base section 111. The legs 109 converge towards one another to define a point where the distance (D1) between the legs 109 is at a minimum. The distance D1 is less than a distance D2 where the legs 109 attach to the base section 111. If a knot is already present, the clip is not required. As can be seen in FIG. 10, the clip 107 is preferably U-shaped.

Additional details concerning the arrangement of the necktie, elastic band and clip are disclosed in the currently co-pending U.S. patent application Ser. No. 10/763,410 of Kim, filed Jan. 23, 2004, (now U.S. Pat. No. 7,096,509) the entirety of which is hereby incorporated by reference.

Figure 11:
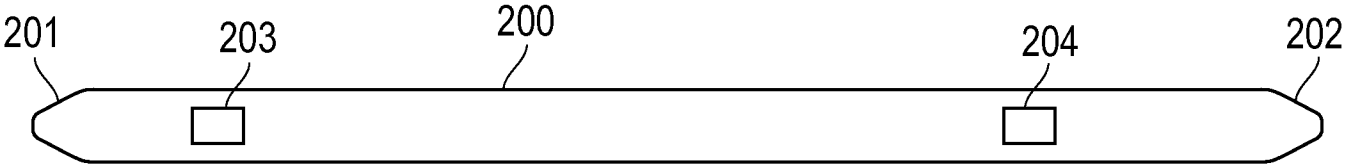
FIG. 11 shows an elongated body useful in holding the shirt and tie combination in a preferred alignment.
Figure 12:
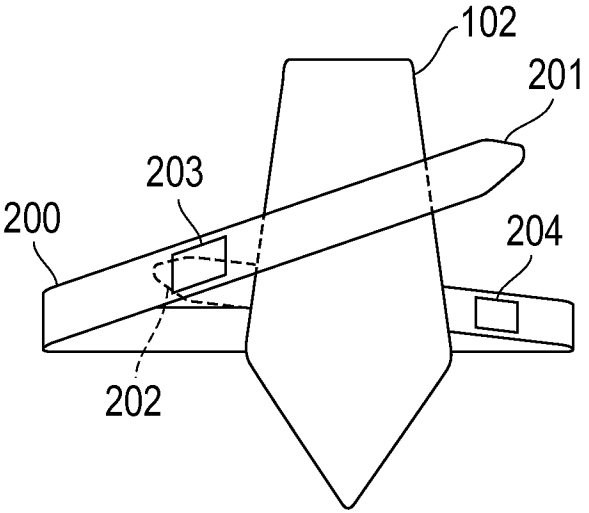
FIG. 12 shows the elongated body being folded.

Referring to FIGS. 11 and 12, an elongated body 200 is shown in FIG. 11 in an unfolded state and in FIG. 12 being brought to the folded state. The elongated body has first and second ends 201 and 202, and first and second attachment points 203 and 204 intermediate of the ends but positioned, as will be apparent, to secure the body in a closed-loop configuration while simultaneously defining a channel for receiving a necktie. The end 202 is brought into engagement with attachment point 203 whereas end 201 is brought into engagement with attachment point 202.

The elongated body 200 is used in conjunction with the shirt (100 in FIG. 13) with the necktie tie (102 in FIG. 12) attached to the shirt. When folded, the elongated body can be made to wrap around the shirt, as shown in FIG. 13.

Figure 13:
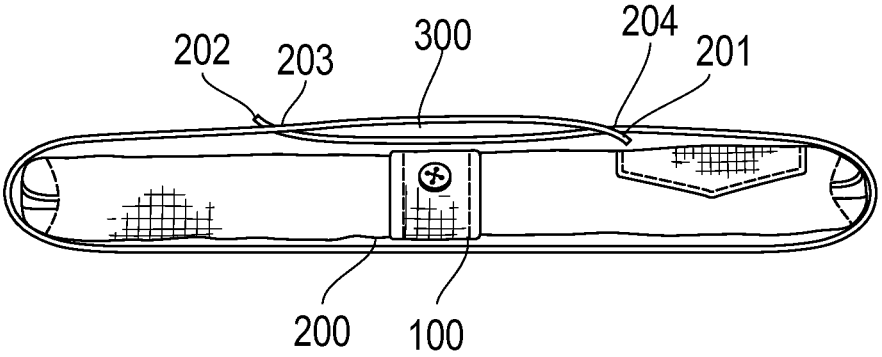
FIG. 13 shows the elongated body in a folded state and disposed around the shirt.

FIG. 13 shows an end view of the elongated body 200 wrapped around a folded shirt 100. There it can be seen that when end 201 is connected to attachment point 204 and when end 202 is connected to attachment point 203, a channel 300, suitable for the insertion of the tie 102 therein, is defined. When the elongated body 200 is plastic, these attachment joints may be defined by cooperation of a lock-tab and a lock-joint, as disclosed in the currently co-pending U.S. patent application Ser. No. 11/166,913 of Kim, filed Jun. 23, 2005, (now U.S. Pat. No. 7,310,857) the entirety of which is hereby incorporated by reference, or by any other method, such as, for example, the use of glue, tape, staples, heat-seal, sewing, etc. Sewing is a particularly preferred approach for achieving the engagement at the attachment points then when the elongated body 200 is made from fabric.

Figure 14:
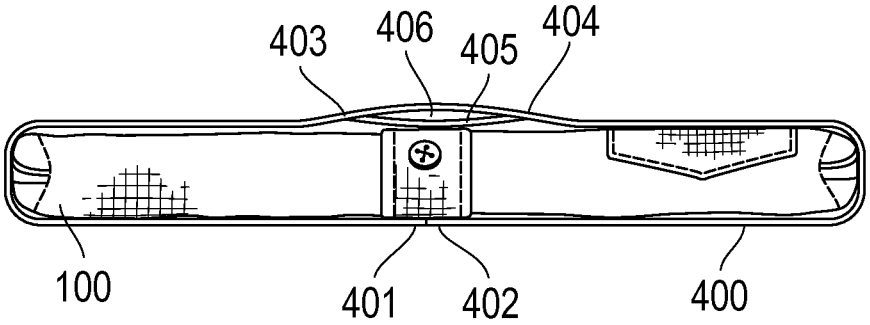
FIG. 14 shows a second embodiment of the elongated body in a folded state and disposed around the shirt.
Figure 15:
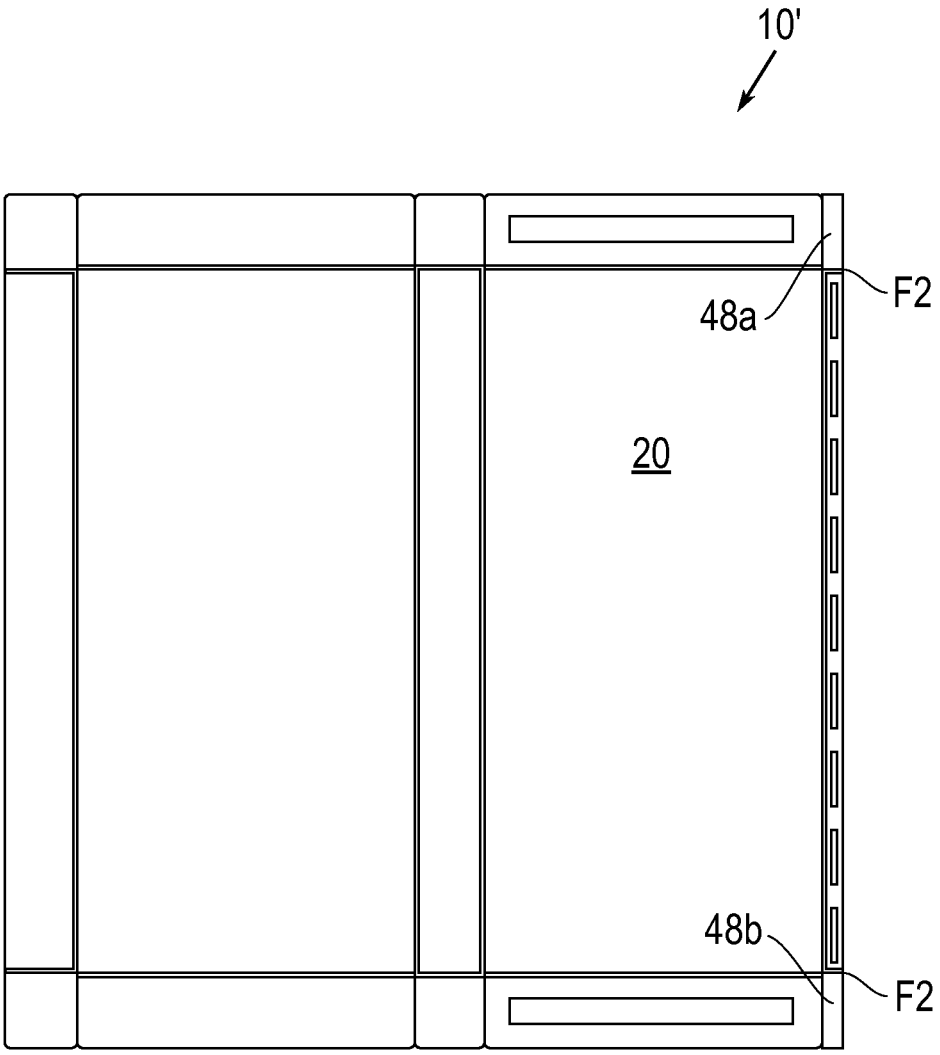
FIG. 15 is a top plan view of a shirt box having multiple bonding elements.

A second embodiment the elongated body of the present invention is depicted in FIG. 14. In this embodiment an elongated body 400 is used. The elongated body is made to form a main loop by attaching its ends 401 and 402. The main loop is suitable for the placement of a folded shirt 100 therein. An additional wall 405, composed, preferably of the same material as the elongated body 400, is attached to the elongated body 400 at two attachment points 403 and 404. A channel 406 is formed between the elongated body 400, the wall 405 and the attachment points 403 and 404 using any of the foregoing attachment methods noted above. The channel 406 is suitable for the placement of a tie therein. Additional reference concerning the use of an elongated body in connection with a shirt and tie is disclosed in U.S. Pat. No. 6,901,636, to Kim, issued Jun. 7, 2005.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A combination of clothing articles packaged for sale within a substantially transparent box comprising;

a folded shirt having a collar;

a necktie supported by the shirt, the necktie being folded and arranged to have at least an appearance of a tie knot that is defined by pinched folded tie fabric, wherein the necktie comprises a length of fabric having first and second ends and at least one fold intermediate the first and second ends that extends across a width of the tie, the fold defining a closed top end of the folded tie;

a substantially transparent box comprising a single sheet of plastic having a series of first panels each defined by a respective fold in a series of first folds in the plastic sheet and a set of second panels each defined by a respective fold in a set of second folds in the plastic sheet, the second panels being folded to define first and second peripheral ends of the box; and a bond permanently connecting one of the first panels to another of the first panels, wherein the panels are connected to define a hollow central cavity for the box, the hollow cavity being sized to receive the shirt and necktie; and a clip engaged with the fabric proximate to the fold, the clip being a separate freestanding structure to allow placement along the folded necktie, the clip having legs that pinch the folded fabric so as to emulate the appearance of a tie knot at a location where the clip is placed, the clip having an open top between the legs that receives the folded fabric and allows the folded fabric to be pinched together by the legs, while being exposed and accessible through the open top to allow insertion and removal therefrom, the folded, closed top end of the tie being spaced from the clip.

2. The combination of packaged clothing articles of claim 1, further including:

an elastic band passing transversely and uninterrupted across the width of the fabric within the fold and sized to be stretchably received about the shirt collar.

3. The combination of packaged clothing articles of claim 1, further comprising a loop disposed about the folded shirt and a channel adjacent the loop, wherein the necktie is disposed in the channel.

4. The combination of packaged clothing articles of claim 1, wherein the bond comprises a plurality of individual bond sites intermittently spaced apart.

5. The combination of packaged clothing articles of claim 4, wherein the individual bond sites are arranged in at least one line.

6. The combination of packaged clothing articles of claim 1, further comprising:

a first and second double-sided tape member, each tape member having opposing sides in adhesive contact with respective second panels.

7. The combination of packaged clothing articles of claim 6, wherein the necktie is positioned proximate the shirt collar and comprises a length of fabric having first and second ends and at least one fold intermediate the first and second ends; the combination further includes including;

an elastic band passing transversely to the length of fabric within the fold and sized to be stretchably received about the shirt collar.

8. The combination of packaged clothing articles of claim 6, further comprising a loop disposed about the folded shirt and a channel adjacent the loop wherein the necktie is disposed in the channel.

9. The combination of packaged clothing articles of claim 6, wherein the bond comprises a plurality of individual bond sites intermittently spaced apart.

10. The combination of packaged clothing articles of claim 9, wherein the individual bond sites are arranged in at least one line.

11. The combination of packaged clothing articles of claim 1, wherein the tie is folded on top of itself and lies within the clip, wherein a first portion of the folded tie that lies within the clip has a width that is less than a width of the folded tie that is disposed on one side of the clip and extends to the fold and less than a width of a second portion of the folded tie that is disposed on another side of the clip and extends to the second end which is a pointed tie end, the folded tie being continuous from the first portion to the second portion.

12. The combination of claim 1, wherein the clip has a bottom section, the and a pair of angled legs that extending upwardly therefrom and are spaced apart from one another at their free ends, the bottom section being planar to allow placement on the folded shirt.

13. The combination of claim 12, wherein the legs converge toward one another to a first point where a first distance (D1) between the legs is at a minimum and less than a second distance (D2) between the legs at points where the legs join the bottom section.

* * * * *